US011284666B2

(12) United States Patent
Morgan et al.

(10) Patent No.: US 11,284,666 B2
(45) Date of Patent: Mar. 29, 2022

(54) TACTICAL IMPACT MITIGATION FOOTWEAR COVER

(71) Applicant: Tate Technology, LLC, Pacific Palisades, CA (US)

(72) Inventors: Jenny T. Morgan, Pacific Palisades, CA (US); Gerard E. Morgan, III, Sandy, UT (US); Cody N. Gifford, Santa Monica, CA (US)

(73) Assignee: TATE TECHNOLOGY, LLC, Pacific Palisades, CA (US)

( * ) Notice: Subject to any disclaimer, the term of this patent is extended or adjusted under 35 U.S.C. 154(b) by 202 days.

(21) Appl. No.: 16/740,276

(22) Filed: Jan. 10, 2020

(65) Prior Publication Data

US 2020/0221816 A1 Jul. 16, 2020

Related U.S. Application Data

(63) Continuation-in-part of application No. 16/738,974, filed on Jan. 9, 2020.

(60) Provisional application No. 62/790,635, filed on Jan. 10, 2019, provisional application No. 62/791,962, filed on Jan. 14, 2019.

(51) Int. Cl.

| | |
|---|---|
| ***A43B 3/16*** | (2022.01) |
| ***A43B 1/14*** | (2006.01) |
| ***A43B 13/18*** | (2006.01) |
| ***A43B 23/02*** | (2006.01) |

(52) U.S. Cl.

CPC ..... *A43B 3/16* (2013.01); *A43B 1/14* (2013.01); *A43B 13/189* (2013.01); *A43B 23/028* (2013.01); *A43B 23/0285* (2013.01)

(58) Field of Classification Search

CPC ..... A43B 13/189; A43B 13/20; A43B 13/203; A43B 13/206; A43B 23/028; A43B 23/0285; A43B 3/16

See application file for complete search history.

(56) References Cited

U.S. PATENT DOCUMENTS

| | | | | |
|---|---|---|---|---|
| 5,283,963 | A * | 2/1994 | Lerner | A43B 17/026 36/28 |
| 5,753,061 | A * | 5/1998 | Rudy | A41D 31/28 156/147 |
| 2016/0377139 | A1* | 12/2016 | Vito | A63B 71/0054 267/141 |
| 2017/0127753 | A1* | 5/2017 | Kohatsu | A43B 13/187 |

* cited by examiner

*Primary Examiner* — Ted Kavanaugh
(74) *Attorney, Agent, or Firm* — Jeffer Mangels Butler & Mitchell LLP; Brennan C. Swain, Esq.

(57) ABSTRACT

A footwear cover that includes a sole portion that includes an inner layer and an outer layer that cooperate to define at least a first interior space therebetween, at least a first bladder member disposed in the first interior space, and an upper connected to the sole portion. The first bladder member defines a bladder interior that includes a non-Newtonian fluid disposed therein. The upper includes at least a first securement strap for securing the footwear cover in a closed position.

13 Claims, 5 Drawing Sheets

TACTICAL IMPACT MITIGATION FOOTWEAR COVER

CROSS REFERENCE TO RELATED APPLICATIONS

This application is a continuation-in-part of U.S. application Ser. No. 16/738,974, filed Jan. 9, 2020, which claims the benefit of U.S. Provisional Application No. 62/790,635, filed Jan. 10, 2019. This application also claims the benefit of U.S. Provisional Application No. 62/791,962, filed Jan. 14, 2019. The entireties of all applications listed above are incorporated herein by reference.

FIELD OF THE INVENTION

The invention generally relates to an assembly that covers footwear and mitigates impact to the wearer.

BACKGROUND OF THE INVENTION

The objective of the present invention is to provide an energy attenuating disposable over boot that mitigates impact forces static line paratroopers and other parachutists receive when they hit the ground. The over boot system is designed to be stripped off and discarded, but may also be reused.

Static line jump maneuvers involve the deployment of the parachute immediately upon debarking from the plane, and utilize standard round parachutes, unlike those preferred and used by most civilians or even other Special Forces. Standard static line chutes are not designed to be controlled by the chute's operator, but rather are strictly used as a means to reach from air to surface with limited directional control by the operator. In a standard static line scenario, a "free fall" jump from 1,000 feet with a total weight of 300 lbs. (including the weight of the operator combined with the weight of standard issue gear and the parachute itself weighing approximately 11 lbs.) and taking in account no air friction and not incorporating the shape of the object falling, the speed or velocity of the parachutist at impact may achieve 77.29 m/s or 172.9 mph. Landing with a full combat load, the parachutist still sustains a tremendous amount of impact force to the feet, ankles, knees, hips, spine; and even a perfect landing still creates significant compression and tension not effectively addressed by existing technologies.

Military static-line parachuting is a well documented "high risk" activity, due to the high impact forces noted above. Most injuries occur to static line jumpers who have severely restricted control over the parachute and a relatively high rate of descent upon landing.

SUMMARY OF THE PREFERRED EMBODIMENTS

In accordance with a first aspect of the present invention there is provided a footwear cover that includes a sole portion that includes an inner layer and an outer layer that cooperate to define at least a first interior space therebetween, at least a first bladder member disposed in the first interior space, and an upper connected to the sole portion. The first bladder member defines a bladder interior that includes a non-Newtonian fluid disposed therein. The upper includes at least a first securement strap for securing the footwear cover in a closed position. In a preferred embodiment, the first bladder member includes a plurality of cells defined therein and each cell includes the non-Newtonian fluid disposed therein. Preferably each cell has a honeycomb shape. In a preferred embodiment, each cell defines a cell axis, the outer layer of the sole portion defines an outer surface, and the cell axes are oriented generally perpendicular to the outer surface. In a preferred embodiment, the first bladder member is made of a polymer.

In a preferred embodiment, the footwear cover includes a plurality of bladder members that are enclosed in a plurality of pockets defined in the sole portion. Preferably, the upper includes a medial portion, a lateral portion, a toe portion, a heel portion and a top portion. The top portion includes a medial closure portion and a lateral closure portion, and the first securement strap is connected to one of the medial closure portion or lateral closure portion. Preferably, the upper includes an inner layer and an outer layer that cooperate to define a second interior space therebetween and at least a second bladder member is disposed in the second interior space. The second bladder member defines a bladder interior, and a non-Newtonian fluid is disposed in the bladder interior. The first and second bladder members may be a single bladder. In other words, the interior space can extend from the sole into the upper and the bladder can extend or wrap from the sole to the upper. Preferably, the second interior space is defined at least partially in the toe portion, the heel portion, the medial portion and the lateral portion and the second bladder member is positioned in one or more of the toe portion, the heel portion, the medial portion and the lateral portion.

In accordance with a first aspect of the present invention there is provided a footwear cover that includes a sole portion that includes an inner layer and an outer layer that cooperate to define at least a first interior space therebetween, and an upper connected to the sole portion. At least a first sole bladder member is disposed in the first interior space. The first sole bladder member defines a bladder interior that includes a plurality of cells defined therein. Each cell includes the non-Newtonian fluid disposed therein and has a honeycomb shape. The upper includes a medial portion, a lateral portion, a toe portion, a heel portion and a top portion. The upper also includes an inner layer and an outer layer that cooperate to define a second interior space therebetween. The second interior space is defined in the toe portion, the heel portion, the medial portion and the lateral portion. One or more upper bladder members are positioned in the second interior space and in the toe portion, the heel portion, the medial portion and the lateral portion. Each of the upper bladder members define a bladder interior that includes a plurality of cells defined therein. Each cell includes the non-Newtonian fluid disposed therein and has a honeycomb shape. The top portion includes a medial closure portion, a lateral closure portion and at least a first securement strap for securing the footwear cover in a closed position. The first securement strap is connected to one of the medial closure portion or lateral closure portion. In a preferred embodiment, the top portion does not include a bladder member (or an interior space defined by inner and outer layers) therein.

The present invention layers may be made with a combination of the cross-referenced inventions that include fluid cells containing the non-Newtonian, or dilatant fluid, and potentially honeycomb layering embedded in disposable textile and polymer skin that the wearer straps to standard issue combat boots or other footwear using Velcro (or some sort of Velcro/nylon/combination) or some other connecting mechanism. The layers may be laminated together using any adhesive, stitched, or some combination.

The present invention cover or over boot product is formed from more than one type of textile in order to incorporate energy attenuation with structural integrity addressing the significant impact force in both linear and rotational acceleration, velocity, and deceleration. As an example, the upper article of the over boot may contain a structure that includes numerous layers formed from various types of textiles, Velcro, and other materials that are lightweight yet strong enough to prevent stretching beyond the design capacity to energy attenuate and remain in place, with lower layers designed that may contain textiles, structures such as honeycomb, and materials containing non-Newtonian fluid, rubbers, polymers, foams, neoprene, and more of the cross-referenced inventions in order to energy attenuate the different properties contained in the entirety of the over boot system.

The entire over boot product system's materials used to complete the over boot element formed are specified shapes joined together through stitching and/or adhesive bonding to form a strong solid single unit comprised potentially of various textile elements that are joined through stitching or adhesive bonding used in the previous art. Textiles that may be used for the present invention include any textile or material manufactured from fibers, filaments, or yarns having a generally two-dimensional structure (i.e., a length and a width). In general, textiles may be classified as non-woven textiles or mechanically-manipulated textiles. Non-woven textiles are webs or mats of filaments that are bonded, fused, interlocked, or otherwise joined. Mechanically-manipulated textiles are often formed by weaving or inter-looping a yarn/fiber or a plurality of yarns/fibers, usually through a mechanical process involving looms or knitting machines. A plurality of the yarns or fibers may be constructed through newer process of fiber separation and matting that provide strength from the weave in a softer format.

The entire over boot product system's materials may also include a high density open cell urethane foam, a microcellular ethylene vinyl acetate (EVA) polyethylene foam, a viscoelastic plasticized polyurethane polymer, a viscoelastic urethane rubber polymer, a vulcanized neoprene, or other highly elastic materials able to withstand impact force, temperature changes also ensuring proper stability in function.

The method embodies an inherent energy attenuation system that is deployed over the base of the sole of the wearers foot, also wrapping around the sole over the arch of the wearers foot to protect and energy attenuate impact force at the point of landing from an aircraft jump; it is a disposable tactical over boot technology system and apparatus that is designed to protect the static line jumper from injury resulting from landing impacts that may also be reused. The current invention is designed to dissipate and energy attenuate impact energy force in which linear and rotational acceleration result from the impact force. The current invention, as a protective disposable tactical over boot, includes a force attenuating reinforcement layer or layers or any combination of layers as needed using Non-Newtonian fluid contained within the over boot having an outer surface, an inner surface, a front region, a rear region, a top region, and two side regions, and with the over boot force attenuating reinforcement layer or layers inside the protective over boot in a variety of form(s) such as honeycomb, with a Non-Newtonian fluid contained within the honeycomb having an outer surface, an inner surface, a front region, a rear region, a top region, and two side regions.

The current invention further is comprised of and encompasses a wide variety of force attenuating reinforcement apparatuses as stated herein, such as honeycomb that are articulated so that the displacement of impacts results in a force component outside the impact axis of the impact of the disposable tactical over boot. The inventive method and apparatuses systems attenuate the propagation of highly linear and nonlinear (rotational) waves.

The current invention further comprises an improved tactical over boot protection system with use of dilitants, shear thickening fluids or non-Newtonian fluid(s) used in tactical over boot protection devices, taking into account the content, consistency, and properties of the fluid(s) and use with impact force. The non-Newtonian fluid(s) transition to act, due to the nature and properties of the non-Newtonian Fluid, as hard as any helmet shell, whether it is polycarbonate, ABS, carbon fiber, or fiberglass, at the point of impact, otherwise the fluid(s) remain naturally in a suspended or fluid state. Non-Newtonian fluids do not undergo strain rates proportional to the applied shear stress. The rheology of the colloidal shear thickening fluid emulsified where a temperature tolerance from −35° to +265° is available using Propylene glycol. Any non-toxic antifreeze is within the scope of the present invention. For example, propylene glycol is considerably less toxic than ethylene glycol and may be labeled as "non-toxic antifreeze." It is used as antifreeze where ethylene glycol may be inappropriate, such as in food-processing systems or in water pipes in homes where incidental ingestion may be possible. For example, the U.S. FDA allows propylene glycol to be added to a large number of processed foods, including ice cream, frozen custard, salad dressings, and baked goods, and it is commonly used as the main ingredient in the "e-liquid" used in electronic cigarettes. Propylene glycol oxidizes to lactic acid.

In the current invention the fluid flows and their directions, combined with the energy flows coincide due to the nature of fluid flows not being generic in the design of the current invention, in other words not being a straight parallel flow from point A to B, such as in a tube or box with boundaries, but with boundary conditions leading to radial flows.

In a preferred embodiment, the current invention is used without hard exterior materials, but with soft encapsulating materials with which to hold the shear thickening non-Newtonian fluid, as well as design the remainder of the tactical over boot. The current invention considers the weight of the shear thickening fluids, as well as the composition where the viscosity increases with shear rate, and at high shear rates instantly transforms into a material with solid-like properties and reverses itself just as quickly once the incident of impact force or shear rate is substantially reduced by energy attenuation through the system, as well as naturally inherent in the dilitant fluid.

The current invention may hold a static mass inside as well as outside, or the two masses, the tactical over boot and the fluid may remain constant. The conservation of mass is in relationship to the soft over boot counterparts, and the density of the fluid remains constant. The current invention also addresses the viscosity of the fluid, which is a constant of proportionality between the viscous stress tensor and the velocity gradient, or the viscosity. Non-Newtonian fluids do not undergo strain rates proportional to the applied shear stress, and Non-Newtonian fluid is viscoelatic, which the current invention addresses. Viscoelasticity is the property of materials that exhibit both viscous and elastic characteristics when undergoing deformation. Viscous materials resist shear flow and strain linearly with time when a stress is applied. Elastic materials strain when stretched and quickly return to their original state once the stress is removed. Viscoelastic materials have elements of both of these properties and, as such, exhibit time-dependent strain. Whereas elasticity is usually the result of bond stretching along crystallographic planes in an ordered solid, viscosity is the result of the diffusion of atoms or molecules inside an amorphous material.

The purpose of the invention is to energy attenuate and dissipate impact force incurred by skydivers/jumpers principally for the military static line paratroopers' landing, and thus reduce the frequency and severity of lower-extremity injuries (with other types) sustained specifically during static-line combat and practice jumping that is the number one cause of lower-extremity fractures.

This invention relates generally to a disposable impact mitigation energy attenuation over boot or footwear (specified as over boot or cover herein) that goes over military tactical infantry boots that are worn by static line jumpers, and which is designed to protect the human foot, ankle, and lower tibia and fibula bones or below the knee, shin, plus hip and spine from injury resulting from ground impacts coming from paratrooper jumps or the like. The invention includes a non-Newtonian fluid with or without honeycomb in a disposable over boot arrangement to address impact mitigation in which acceleration, velocity, or g-force, plus angular, rotational, extension or flexion motion resulting from over rotation or unintended or improper technique of landing. The present invention may also work in conjunction with or be added to rearely used ankle protection, or a "PAB," or a Parachute Ankle Brace.

The basic invention includes a wrap-around non-Newtonian lower boot and base or sole that serves as the energy attenuation or impact mitigation base of the over boot. The lower boot and base of the over boot is comprised of non-Newtonian fluid, as noted above in the related applications, and may include honeycomb. The base is designed to have a good grip on dry and wet, as well as angular or uneven surfaces. The sole wraps around the base of the foot, top and heel, and up to the ankle for greater protection with landing on uneven surfaces. The over boot slips on over currently used military boots anchoring the toe and heel coupled with a Velcro strapping system that consists of three straps or parts. The over boot wraps up, over and around the ankle to provide additional support, and strength in a single unit boot. The toe strap that goes on the frontal part of the over boot straps across on an angular basis starting at the outside little toe securing across the lower arch; the middle strap starts midway up the arch on an angular basis across to the base of the ankle bone, or base of the tibia bone—this prevents the over boot from stretching in problematic positions where injury could occur, and the upper strap secures around the ankle bone also to prevent the over boot from slipping off. Each strap is connected to the over boot.

The following synopsis represents a summary of aspects of the invention to provide a basic understanding of the invention, and the purpose of the invention. This summary provides an overview of the invention, and is not intended to identify all key critical elements of the invention, or to define/describe the scope, capacity or opportunity of the invention. The summary simply provides some concepts of the invention in a general form, as an introduction to the comprehensive description outlined below.

Aspects of the invention pertain to tactical over boot receiving devices, which include a foot member, a rear or heel member, a front or toe member, two side members, and a crown/top or arch member, all of which respectively are complete units, engaged and integrated into one complete footwear unit designed as an over boot system to be applied as a unified or single disposable unit or over boot layered with energy attenuating non-Newtonian fluid and other materials and structures system. The over boot member(s) may include an enclosed plastic or flexible polymer system with a cavity to house or contain Non-Newtonian fluid(s), which may include and house or contain honeycomb or similar shape therein. The over boot member(s) may also include or define a cavity or void to house or hold the honeycomb combined with the non-Newtonian fluid energy dissipation and attenuation properties. The over boot member(s) may also include or define a cavity, or cavities, numerous voids to house or hold the non-Newtonian fluid where the Non-Newtonian fluid can be enclosed.

One feature of the present invention, is directed to the over boot member, or specifically to the base of an over boot sole member structure for an article of the over boot, the sole structure comprising an outer member and a plurality of other outer members designed to fit over/with the wearers paratrooper boots as an over boot, as well as engage with the ground to energy attenuate extending away from the wearer in an over boot member and energy attenuate directly from the base portion of the sole structure or member.

Another feature of the present invention is directed to an article of an over boot, including upper members, a base or sole member structure, the toe or front member, the rear, back, or heel member, and two side members. The base or sole member structure includes an outer member and a plurality of impact engaging members designed throughout the base portion of the outer member. The toe member structure includes an outer member and a plurality of impact engaging members designed throughout the toe portion of the outer member. The back or heel member structure includes an outer member and a plurality of impact engaging members designed throughout the heel portion of the outer member. The two side members structures include an outer member and a plurality of impact engaging members designed throughout the two side members portion of the outer member.

Another feature of the invention is the plurality of impact engaging members including a first impact engaging member in the sole or base of the over boot, a second impact engaging member in the toe of the over boot, a third impact engaging member in the heel of the over boot, and a fourth impact engaging member in the two sides of the over boot, and a plurality of top, crown or arch members attached to the base portion of the outer member. The plurality of panels is unified into one panel included and bounded by the first, second, third, and fourth impact engaging members. The sole structure at least partially comprises an auxetic structure (Auxetics are structures or materials that have a negative Poisson's ratio when impacted, they become thicker perpendicular to the applied force. This occurs due to their particular internal structure and the way this deforms when the sample is uniaxially loaded), via use of the honeycomb, and partially comprises the energy attenuating property of the non-Newtonian fluid contained therein in enclosed honeycomb cells that hardens temporarily when struck with impact force, which engages and limits the need of the auxetic motion to fully engage the impact force alone.

Another feature of the invention where the first impact engaging member, the second impact engaging member, the third impact engaging member, and the fourth impact engaging members also partially exhibit an auxetic motion through the use of the non-Newtonian fluid in these members.

Another feature of the invention is the plurality of all impact engaging members includes a first impact engaging member, where the entire first or base member is a first impact engaging member, which may also be termed as an apex. The first impact engaging member includes a first design and a second design, where the apex has a first height with respect to the base portion in the first design, and the apex has a second height with respect to the base portion in the second design to follow the base design of the wearer's paratrooper boots. The first height, or heel height is greater than the second height, or sole of the foot height, where there is a subtle transition, not hard angled corners between the first height and the second height, where the second height is approximately zero, and the heel or first height is greater than the second or sole height. All impact engaging structures at least partially comprises an auxetic structure in the use of honeycomb and other materials, and partially comprises the use of non-Newtonian fluid, and the plurality of impact engaging members are arranged on the outer member to provide the base sole, base heel, two sides, toe and heel structures with the auxetic structure combined with use of non-Newtonian fluids.

Another feature of the invention is the base or sole structure of the first impact engaging member in the over boot, where the first member or sole structure includes an outer member, and inner member, and side members enclosing a plurality of impact engaging members in the form of honeycomb where each cell of the honeycomb member engages the outer member of the sole, the inner member of the sole, and some engage with the sides of the sole in a continuous system member as the base or sole. The plurality of the first impact member also engaging the honeycomb members comprise at least a first, a second, and a transition member between the first and second impact engaging member of the sole.

Another feature of the invention is the plurality of the second, third, and fourth engaging impact members that may have an outer member, an inner member and side members enclosing the honeycomb where some of sides of the honeycomb may engage with the side member of the engaging impact members. The first, second, third and fourth impact engaging members are joined at an apex where at least partially a portion of each impact engaging member overlaps and is fused, glued, sewn or a combination to connect the plurality of these members to form the base or sole and the partial toe, heel and sides of the over boot members. The plurality of these structures at least partially comprises an auxetic structure, and partially comprises a non-Newtonian structure and the plurality of impact engaging members are arranged to form the base of the over boot to energy attenuate impact force.

Another feature of the invention is the textile upper, crown, or arch member portion of the over boot where the totality of the impact engaging members all connect to secure the over boot for the wearer. The arch member engages with the plurality of the impact engaging members closing the over boot. The arch member uses three sewn and glued on Velcro straps to the textile upper or arch member to close the crown or arch of the over boot with the first face of the Velcro strap initiating at the toe of the toe member diagonally crossing over the arch to close the upper crown member towards the ankle, the second face of the Velcro strap initiating at the mid-arch region of the upper member diagonally crossing over the mid-arch to close the upper crown member towards and under the ankle, and the third face of the Velcro strap initiating at the rear-arch region of the upper member diagonally crossing over the upper-arch to close the upper crown member towards and above the ankle. The cowl neck of the opening of the upper or crown portion is designed to easily receive the wearers' boots or footwear.

The method of the present invention embodies an inherent energy attenuation system contained in a closed/sealed honeycomb sole made of polyurethanes, polyolefins, high density open cell urethane foam, a microcellular ethylene vinyl acetate (EVA) polyethylene foam, a viscoelastic plasticized polyurethane polymer, a viscoelastic urethane rubber polymer, a vulcanized neoprene, or other highly elastic materials able to withstand impact force, temperature changes also ensuring proper stability in function, or any polymeric material to contain and maintain the shear thickening fluid locked within the inner honeycomb layer contained within the engaging impact members in a permanently enclosed environment to dissipate and energy attenuates impact force from an impact or a landing. The present invention also includes in the upper member breathable or wicking material or textile to close the over boot system. The non-Newtonian fluid, or STF thickening properties at impact, or point of compression allows the soft materials and fluids to behave like a hard helmet shell, and the transfer of impact force at the point of compression into the STF contained within the honeycomb is enabled by the engaging impact members to act as impact mitigation properties. The STF fluid may also return to its fluid or liquid state post the impact, and may act or behave the same with each repeated impact. The present invention is a disposable tactical over boot technology system and apparatus that is designed to protect the wearer from injury resulting from static line jumping and other impacts using four engaging impact members contained in the sole, heel, toe, two sides of material, with outer and inner layers using a polyurethanes, polyolefins or any polymeric material to contain and maintain the shear thickening fluid using a honeycomb system used to house the STF to dissipate and energy attenuate the impact force resulting from contact at the point of compression in a disposable tactical static line paratrooper jumper over boot, or for other similar use technology system.

The method embodies a disposable tactical static line paratrooper jumper over boot technology system that is activated by the impact force on the honeycomb coupled with the Non-Newtonian, or STF fluid contained within the outer and inner layers of the four engaging impact members system of the over boot resulting in dissipation and energy attenuation of the impact force at the point of impact, or compression.

The present invention looks at a wearers protective device for protection from impact-based injuries, especially relating to static line jumping activities, is provided by four engaging impact members of the over boot with outer and inner material/element/members, with an inner enclosed plastic or flexible polymer system with a honeycomb system to house or contain non-Newtonian fluid(s) therein.

The present invention has an outer layer attached to the inner layer with side layers housing an inner honeycomb system throughout the entire base/sole and heel of the over boot. The four engaging impact members are connected at the intersections of the four sole, toe, heel and two side members, which may be constructed using stitching or sewing, sealants or adhesives, heat sealing, cements, glues, fusing techniques, and other materials or techniques not listed, or a combination thereof, and potentially throughout the over boot with the Non-Newtonian or STF fluid system contained and sealed therein and contained within the outer and inner layers in the honeycomb system's cells.

The over boot member, in some instances, may exhibit a combined configuration that includes durable, temperature resistant, flexible comfortable outer and inner layers including the honeycomb layer in the four engaging impact members (formed out of some polymer, such as flexible plastic, including, but not limited to thermoplastics including polyethylene, polypropylene, polystyrene, polyvinyl chloride, as well as vulcanized neoprene, rubber, polytetrafluoroethylene, and more) with the textile top/crown or arch layer also a soft pliable wicking material to address compressive pressure from impact force to the wearer in an impact. Suitable flexible yet resilient plastics used for the over boot system that is flexible, but durable for holding shape under impact conditions, excessive heat and cold conditions, not losing its strength or shape in the entire over boot system may be joined to one another in various different methods, such as mechanical connectors, stitching or sewing, adhesives, cements, glues, fusing techniques, and other materials or techniques not listed.

The current invention is a disposable impact over boot technology system and apparatus that is designed to protect the jumper from injury resulting from static line jumping and other impacts that may also be reused. The current invention is designed to protect the ankle, knee, spine, and neck from the impact force.

An impact absorbing tactical impact mitigation disposable over boot technology device to be used for static line paratrooper jumps and landings is described. Four impact engaging members of the over boot are designed with use of the cross-referenced patents using non-Newtonian fluid with proven ability to energy attenuate impact force coupled with honeycomb, which encapsulates the non-Newtonian fluid in each individual honeycomb cell in a sheet contained therein in each of the four impact engaging members in the over boot footwear device. A textile upper member connects with the four engaging members to form and complete the over boot, which is easily secured and easily and rapidly removed via three Velcro straps to secure the over boot, also designed with an open cowl neck for the wearer to easily be able to don the over boot. The four impact engaging members include the sole or base, top, heel, and two sides that may be constructed out of a number of materials from the prior art using polyurethanes, polyolefins, high density open cell urethane foam, a microcellular ethylene vinyl acetate (EVA) polyethylene foam, a viscoelastic plasticized polyurethane polymer, a viscoelastic urethane rubber polymer, a vulcanized neoprene, or other highly elastic materials able to withstand impact force, temperature changes also ensuring proper stability in function, or any polymeric material. The layers may be laminated together using stitching or adhesive, or a combination as used in the prior art. The over boot may have an outer layer and an inner layer of solid yet flexible and durable impact resistant material from the prior art, and the honeycomb member within each of the four impact engaging members containing the non-Newtonian fluid. The upper member completes the over boot that consists of a textile material making the boot easily secured, and easy to pull over the wearers footwear/boots. The over boot having an upper and four impact engaging members including a sole member, a toe member, a heel member, and two side members secured to the upper, the upper including a textile component that is formed of unitary knit or woven fabrication with the upper member comprising a first region forming a solid yet open collar of the upper to be folded over itself (cowl neck opening) and secured with the Velcro straps where the separate Velcro strands form a plurality of over lapping straps positioned immediately and closely adjacent to each other overlapping upon itself so as to form a closure aperture of the collar of the upper member, the collar being flexible yet over stretch-resistant, the collar having an opening to accommodate or receive the wearers foot and boots worn being able to easily pull on the over boot, similar to a cowl neck on a sweater to receive the wearers head, the upper member being all one piece. The four impact engaging members are secured to the upper member forming the complete over boot system. An over boot, comprising an energy attenuation construction.

The over boot wherein the four impact engaging members comprised of the sole or base, top, heel, and two sides construction for the over boot contain therein non-Newtonian fluid of the cross referenced patents housed within the honeycomb layer comprised of a plurality of adjoining cells containing the non-Newtonian fluid 100% sealed therein to substantially mitigate impact force. The over boot where each of the honeycomb cells hold the non-Newtonian fluid in a completely enclosed or sealed environment. The over boot where the honeycomb cells comprise a pre-shaped or designed sheet of honeycomb in the shapes of the four impact engaging members containing the non-Newtonian fluid of the over boot. The over boot where the honeycomb is sealed with an inner or top layer, and an outer or bottom layer to completely enclose and seal the honeycomb cells containing the non-Newtonian fluid in a pre-shaped or designed sheet of honeycomb in the specific shapes of the four impact engaging members of the over boot.

The over boot where the honeycomb with the non-Newtonian fluid pre-shaped or designed sheet of honeycomb in the shapes of the four impact engaging members are contained within the four impact engaging outer and inner layer members of the over boot. The over boot having a first layer of a base or sole impact engaging member of the over boot having the sole securement surface along a top thereof to be secured to the toe, heel and two side impact engaging members using adhesive or bonding process forming the base of the over boot, or footwear receiving device. The over boot having a first layer of a toe impact engaging member of the over boot having the sole securement surface along a top thereof to be secured to the base, heel and two side impact engaging members using adhesive or bonding process forming the base of the over boot, or footwear receiving device.

The over boot having a first layer of a heel impact engaging member of the over boot having the sole securement surface along a top thereof to be secured to the toe, base, and two side impact engaging members using adhesive or bonding process forming the base of the over boot, or footwear receiving device. The over boot having a first layer of a two sides impact engaging member of the over boot having the sole securement surface along a top thereof to be secured to the toe, heel and base impact engaging members using adhesive or bonding process forming the base of the over boot, or footwear receiving device.

The over boot having a first layer of upper member of the over boot having the sole securement surface along a top thereof to be secured to the toe, heel, and two sides impact engaging members using stitching and/or adhesive or bonding process forming the base of the over boot, or footwear receiving device. The over boot having the upper member securement in the form of three Velcro strips to secure the over boot to the wearer's foot. The over boot where at least one layer of said four impact engaging members is comprised of materials from the prior art using polyurethanes, polyolefins, high density open cell urethane foam, a microcellular ethylene vinyl acetate (EVA) polyethylene foam, a viscoelastic plasticized polyurethane polymer, a viscoelastic urethane rubber polymer, a vulcanized neoprene, or other highly elastic materials able to withstand impact force, temperature changes also ensuring proper stability in function, or any polymeric material.

The over boot where the base of the over boot shall have a gripping or treaded sole of the prior art for initial impact with the ground. The over boot having a textile component that is formed of unitary knit or woven fabrication with the upper member comprising a first region forming a solid yet open collar of the upper to be folded over itself and secured with the Velcro straps where the separate Velcro strands form a plurality of over lapping straps positioned immediately and closely adjacent to each other overlapping upon itself so as to form a closure aperture of the collar of the upper member, the collar being flexible yet over stretch-resistant, the collar having an opening to accommodate or receive the wearers foot and boots worn being able to easily pull on the over boot, similar to a cowl neck on a sweater to receive the wearers head, the upper member being all one piece.

In order to facilitate thermal bonding of the various components of the footwear cover, at least one of components may include a thermoplastic polymer material. One or more of the components may be woven textile, other textiles that incorporate yarn or thread in a weave or other in the prior art or other textiles that incorporate a thermoplastic polymer material. Moreover, one of components may be another textile (i.e., knitted, woven, non-woven), an element of polymer sheet.

Using the process discussed herein, the thermoplastic polymer material in either of components and textile material in may be secured using either stitching or adhesive sealing bonding or a combination to secure these components into one over boot member. A thermoplastic polymer material melts when heated and returns to a solid state when cooled sufficiently. Based upon this property of thermoplastic polymer materials, thermal bonding processes may be utilized to form a thermal bond that joins components to each other. The configuration of the thermal bond at least partially depends upon the materials and structure of components. As a first example, the top portion may be woven textile. Upon heating, the thermoplastic polymer material from each element of woven textile the top portion may intermingle with each other to secure the lower portions that include the non-Newtonian fluid to the top portion when cooled. Similarly, these components may be secured via stitching. Seams may also be added using stitching for textile material support of the top member.

There may be many modifications to the specifically described structures, systems, and methods of the invention may take place without departing from this invention. As an example, while the invention has been specifically described with respect to specific examples including preferred modes of carrying out the invention, those skilled in the art may appreciate that there may be numerous variations, combinations, and permutations of the above described systems and methods. Furthermore, various specific structural features included in the examples merely represent examples of structural feathers that may be included in some examples of structure according to the invention. Furthermore, with respect to the methods, many variations in the method steps may take place, the steps may be changed in order, various steps or features may be added changes, or omitted, etc., without departing from the invention. Thus, the reader should understand that the spirit and scope of the invention should be construed broadly as set forth in the appended claims.

The present invention is a tactical impact mitigation disposable over boot technology system and apparatus including an over boot system with honeycomb, honeycomb cells, non-Newtonian fluid, four impact engaging members, the upper member, the Velcro securement straps, the treaded sole, stitching or seams, and adhesive or gluing securement.

Other systems, methods, features and advantages of the embodiments may be, or may become, apparent to one of ordinary skill in the art upon examination of the following figures and detailed description. It is intended that all such additional systems, methods, features and advantages be included within this description and this summary, be within the scope of the embodiments, and be protected by the following claims.

DETAILED DESCRIPTION OF THE PREFERRED EMBODIMENTS

Figure 1:
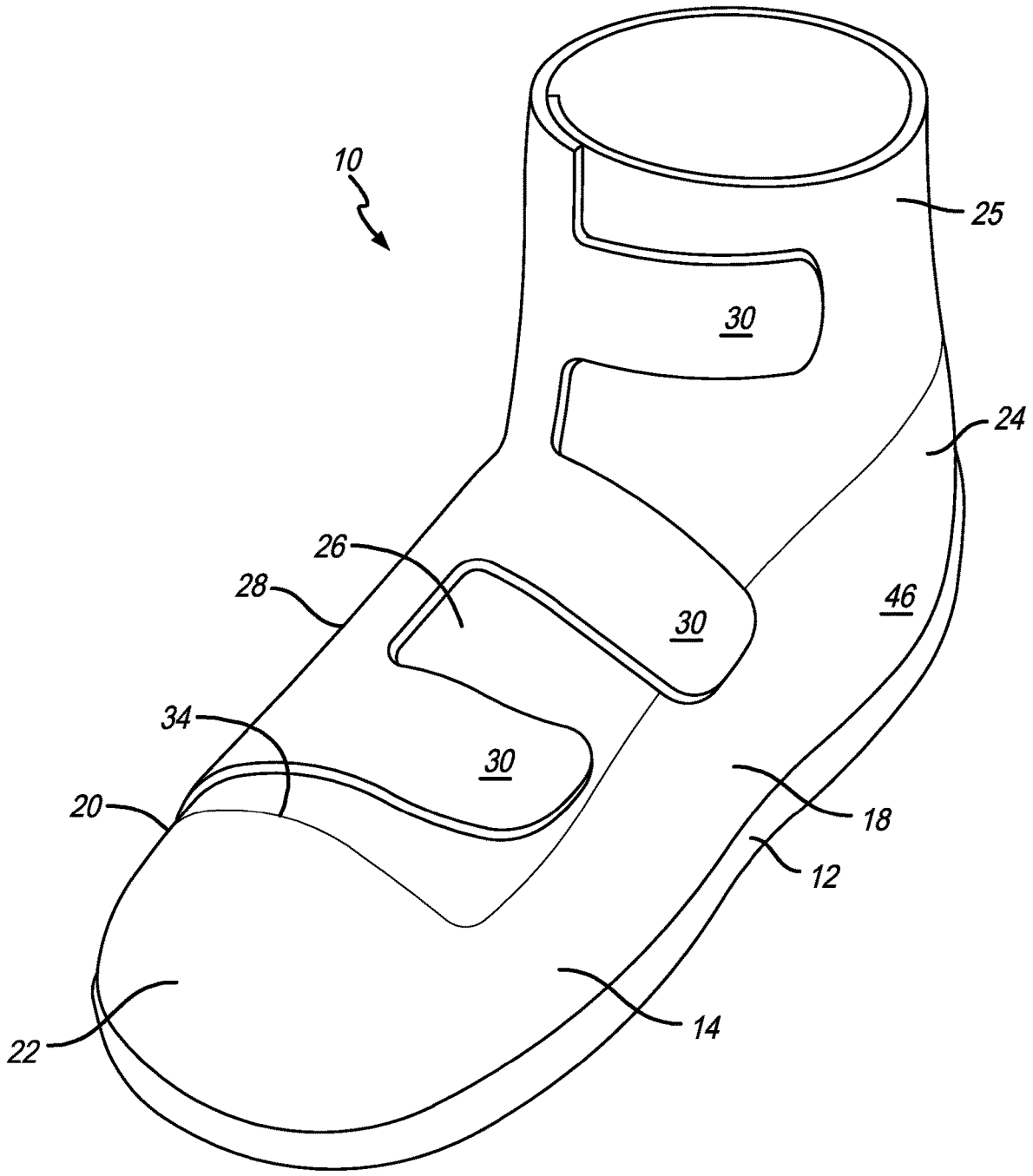
FIG. 1 is a perspective view of an article of footwear in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments.

Reference in this specification to "one embodiment" or "an embodiment" means that a particular feature, structure, or characteristic described in connection with the embodiment is included in at least one embodiment of the-disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It may be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, may control.

It may be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

The following description includes various examples of the invention, which are referenced and reference is made to the associated drawings, which form a part hereof, and in which are shown by way of illustration example systems. Also, the following description includes various examples of the invention, which are referenced and reference is made to the associated drawings, which form a part hereof, and in which are shown by way of illustration example environments and usage the invention may be employed. It is to be stated that other configurations, usages, aspects of use, parts, portions, example systems may be used and structural and functional modifications or alterations may be made without taking leave from the scope of the present invention. Terms, such as "around," "through," "top," "bottom," "side," "above," "below," "underneath," "over," "clear," "transparent," "inner," "outer," "impact," "engaging," "fluids," "soft," "pliable," "wicking," "single," "double," "force," "impact," "linear," "rotational," "angular," "acceleration," "mitigation," "cowl," "engagement," etc. may be used to describe the invention, and the various examples, and example aspects, facets, features, elements of the invention; these terms are used herein as a matter of descriptors and for practicality and expediency based upon the example orientations as shown in the illustrations. Nothing in this specification should be construed as requiring a specific three-dimensional orientation of structures in order to fall within the scope of this invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments.

Reference in this specification to "one embodiment" or "an embodiment" means that a particular feature, structure, or characteristic described in connection with the embodiment is included in at least one embodiment of the-disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It may be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, may control.

A non-Newtonian fluid system, a honeycomb system, four engaging impact members and apparatus designed to protect the wearer from injury resulting from static line paratrooper landing impacts in which acceleration, angular, linear, rotational, extension or flexion/extension motion resulting from an impact force requires an impact force energy attenuation footwear over boot device. The method embodies an inherent honeycomb system housing the non-Newtonian fluid in four engaging impact members that is engaged with resulting impact force at the point of compression resulting in the non-Newtonian fluid energy attenuating impact force including both linear and rotational velocity and acceleration in the disposable tactical impact over boot.

A disposable tactical impact over boot technology system/member and apparatus designed to protect the wearer from injury resulting from static line paratrooper landing impacts in which linear acceleration, angular, and/or rotational acceleration, deceleration or velocity resulting from an impact force, as well as hyper-flexion or hyper-extension requires engagement of the non-Newtonian fluid coupled with the honeycomb system in four engaging impact members at impact. A disposable tactical impact over boot technology system/member and apparatus designed to protect the wearer from injury resulting from static line paratrooper landing impacts in which linear acceleration, angular, and/or rotational acceleration, deceleration or velocity resulting from an impact force, as well as hyper-flexion or hyper-extension requires engagement of the non-Newtonian fluid coupled with the honeycomb, and the four engaging impact members in an over boot system when the wearer lands on a flat surface, or an angular or uneven surface energy attenuating the impact force to the wearer.

Some aspects of the present invention relate generally to tactical impact mitigation disposable over boot system for safety in static line paratrooper jumps, and other uses. The figures generally illustrate examples of the invention, and the description describes how the tactical impact mitigation disposable over boot system fits over the wearer's combat boots. The impact mitigation system using honeycomb may occupy one or more placements within the base, toe, heel, and two sides of the impact engaging portion of the over boot system. The non-Newtonian fluid may occupy one placement within the base, toe, heel, and two sides of the impact engaging portion of the over boot system.

The tactical impact mitigation disposable over boot system may be formed from a variety of comfortable textile wicking materials already in use in today's market, and may be formed with a variety of characteristics in the prior art.

The tactical impact mitigation disposable over boot system four impact engaging member portions of the over boot contains the non-Newtonian fluid system, contained within the honeycomb cell system, including each individual honeycomb enclosed and sealed cell may hold non-Newtonian fluid independently, all distributed uniformly and throughout the entirety of the impact engaging four member system of the over boot system starting at the sole of the over boot to the toe of the over boot system, to the heel of the over boot system, and to the two sides of the over boot system. The depth of the honeycomb may be greater/thicker at the base or sole of the impact engaging member of the over boot system. The ground contact base portion of the over boot system may be formed to have a design to grip the ground used in the prior art. The toe and heel portions of the impact engaging member of the over boot system, which are continuous from the sole portion of the over boot system may not need to be as great/thick as the base or sole, and the two sides of the over boot system, also continuous from the sole portion of the over boot system may be as great/thick as the sole member to address hyper-extension/hyper-flexion of the wearers ankle, rolling and snapping the wearer's ankle, and more. The crown or arch portion of the over boot system is stitched, glued, or some form of contact to maintain positioning into the four impact engaging members of materials of the over boot. The Velcro straps to secure the over boot to the wearers foot may be located at three locations starting at the toe area crossing over the arch to secure in front of the wearers ankle, the middle strap starts at the mid-arch crossing over to secure just under the wearer ankle, and the top strap starts at the base of the tibia/fibula crossing over to secure above the wearers ankle. The opening or cowl neck of the upper portion makes it easier for the wearer to slip their boots or footwear into the over boot system.

The honeycomb with non-Newtonian fluid system of an example embodiment of the invention may occupy from 1% up to 100% of the four impact engaging member portions of the sole, top, heel, and two side engaging members of the over boot system, i.e., up to 100%, of the four impact engaging members of the over boot system and region or area. The crown or arch system of an example embodiment of the invention may occupy a portion of the entire over boot system of at least 10% or up to 50%, of the over boot system and region or area. The Velcro straps system of an example embodiment of the invention may occupy a portion of the entire over boot system, i.e., at least 5%, or up to 50%, of principally the crown, upper, or arch portion of the over boot system and region or area.

As already described, the one or more protrusions included in the over boot system and the sole or base impact engaging member of the over boot system as an example of the embodiment of the invention, all of which may extend laterally, vertically, may have depth, may have height, and may be in three dimensional form.

Also, the one or more protrusions included in the over boot system and the toe impact engaging member of the over boot system as an example of the embodiment of the invention, all of which may extend laterally, vertically, may have depth, may have height, and may be in three dimensional form.

Also, the one or more protrusions included in the over boot system and the heel impact engaging member of the over boot system as an example of the embodiment of the invention, all of which may extend laterally, vertically, may have depth, may have height, and may be in three dimensional form. Also, the one or more protrusions included in the over boot system and the two sides impact engaging member of the over boot system as an example of the embodiment of the invention, all of which may extend laterally, vertically, may have depth, may have height, and may be in three dimensional form. Also, the one or more protrusions included in the over boot system and the crown, arch, or upper impact engaging member of the over boot system as an example of the embodiment of the invention, all of which may extend laterally, vertically, may have depth, may have height, and may be in three dimensional form.

The honeycomb system may be formed of a variety of materials and/or include a variety of features or element to alter or adjust characteristics of the honeycomb impact receiving device. For example, the pliable and durable honeycomb system may be formed out of some polymer, such as flexible plastic, including, but not limited to plastics, thermoplastics including polyethylene, polypropylene, polystyrene, polyvinyl chloride, plus polytetrafluoroethylene, plus rubber, vulcanized neoprene, and other materials.

The Velcro system may be formed of a variety of materials and/or include a variety of features or elements to alter or adjust characteristics of the Velcro securement system. The upper, crown, or arch portion of the over boot system may be formed of a variety of materials and/or include a variety of features or elements to alter or adjust characteristics of the upper portion of the over boot system. Other securing systems, such as buttons, snaps, straps, dial closures, ratchet systems may also be used.

Also, the one or more protrusions included in the ground contact base over boot system engaging member of the over boot system as an example of the embodiment of the invention, all of which may extend laterally, vertically, may have depth, may have height, and may be in three dimensional form. Additional aspects of the invention include methods of providing and methods of using over boot systems.

For example, to insert the non-Newtonian fluid system wherein the cells of the honeycomb contains the non-Newtonian fluid, wherein the non-Newtonian fluid is 100% enclosed and sealed within the honeycomb system, and wherein the honeycomb is contained within the engaging impact members including the sole or base member, top member, heel member and two sides members.

To insert the honeycomb system containing the non-Newtonian fluid, wherein the non-Newtonian fluid is contained within each individual honeycomb cell, and wherein the non-Newtonian fluid is 100% enclosed or sealed in each individual honeycomb cell, and wherein the entirety of the honeycomb cell structure is a honeycomb system, and wherein the honeycomb is contained within the engaging impact members including the sole or base member, top member, heel member and two sides members.

To insert and/or attach the crown, arch, or upper layer of the over boot system, wherein the upper portion member of the over boot system is attached to the four impact engaging members to close the over boot system over the wearers footwear.

To insert and/or attach the Velcro straps to the crown, arch, or upper layer of the over boot system, wherein the Velcro straps may be attached using stitching, adhesive, or some combination therein or other methods of attachment. One or more protrusions extending from the Velcro straps to the crown, arch, or upper layer of the over boot system.

The over boot system receiving device when worn with other footwear, including the four impact engaging members containing the non-Newtonian fluid contained within the honeycomb system may not present the human or a wearer with an abnormal feeling of fit, comfort, or the like. Optimally, the invention may be worn with other footwear.

Specific examples of the invention and the structures according to the examples of the invention are described in greater detail below. The reader should be aware that these specific examples and structures are set forth simply to illustrate the invention, and they should not be construed as limiting the invention.

Some aspects of the present invention relate generally to the wearers safety protection systems, for protective equipment for safety in static line paratrooper jumps and landings, and other uses. The non-Newtonian fluid system, may occupy one or more placements within the over boot system of the tactical impact mitigation disposable over boot technology system. The non-Newtonian fluid system may occupy one or more placements within the over boot. The non-Newtonian fluid system may occupy one or more placements within the honeycomb contained within the over boot. The outer and inner layers, and/or closed/sealed honeycomb, and outer and inner layers made of plastics materials, including, but not limited to polyurethanes, polyolefins or any polymeric material, high density open cell urethane foam, a microcellular ethylene vinyl acetate (EVA) polyethylene foam, a viscoelastic plasticized polyurethane polymer, a viscoelastic urethane rubber polymer, a vulcanized neoprene, or other highly elastic materials able to withstand impact force, temperature changes also ensuring proper stability in function, or any polymeric material may occupy one or more placements within the over boot system, and the upper layer may be made from a variety of textiles that may also be breathable and stretchable wicking material layer of the over boot system.

The tactical impact mitigation disposable over boot technology system upper layer may be formed from a variety of comfortable textiles and/or wicking materials already in use in today's market, and may be formed with a variety of characteristics in the prior art.

The tactical impact mitigation disposable over boot technology system honeycomb layers may be formed from a variety of plastic materials plastics, rubber, vulcanized neoprene, polyurethanes, polyolefins or any polymeric material, and more system may be formed from a variety of materials. The outer and inner layers, or closed/sealed members made of plastics, rubber, vulcanized neoprene, polyurethanes, polyolefins or any polymeric material, and more system may be formed from a variety of materials.

Aspects of the invention relate to safety systems in static line paratrooper jumps and landings and relates to a tactical impact mitigation disposable over boot technology system means any device that a user places on or over some portion of the human or wearers foot and footwear to mitigate impact forces derived from a paratroopers, or jumpers landing on the ground, or the like. The tactical impact mitigation disposable over boot technology system receiving device, (i.e. a tactical impact mitigation disposable over boot technology system designed to protect the users foot, ankle, knee, hip, and spine areas through impact mitigation), which is a tactical impact mitigation disposable over boot technology system and apparatus including an over boot system with four impact engaging member portions of the over boot contains the non-Newtonian fluid system, contained within the honeycomb cell system, including each honeycomb enclosed and sealed cell may hold non-Newtonian fluid independently, all distributed uniformly and throughout the entirety of the impact engaging four member system of the over boot system starting at the sole of the over boot to the toe of the over boot system, to the heel of the over boot system, and the two sides of the over boot system. The depth of the honey comb may be greater/thicker at the base or sole of the impact engaging member of the over boot system. The ground contact base portion of the over boot system may be formed to have a design to grip the ground used in the prior art. The toe and heel portions of the impact engaging member of the over boot system, which are continuous from the sole portion of the over boot system may not need to be as great/thick as the base or sole, and the two sides of the over boot system, also continuous from the sole portion of the over boot system may be as great/thick as the sole member to address hyper-extension/hyper-flexion, etc. of the wearer's ankle. The crown or arch portion of the over boot system is stitched, glued, or some form of contact to maintain positioning in to the four impact engaging members of materials of the over boot. The Velcro straps to secure the over boot to the wearers foot may be located at three locations starting at the toe area crossing over the arch to secure in front of the wearer's ankle, the middle strap starts at the mid-arch crossing over to secure just under the wearer ankle, and the top strap starts at the base of the tibia/fibula crossing over to secure above the wearers ankle. The cowl neck of the opening of the upper or crown portion is designed to easily receive the wearers' boots or footwear.

The over boot system receiving device when worn independently, may not present the user or a wearer with an abnormal feeling of fit, comfort, or the like. The over boot is used to mitigate impact forces derived from a paratrooper, or sky dive jumper landing on the ground, or the like.

The over boot system in the form of an over boot may be used for impact protection and mitigation and other various uses in today's markets is used as a base shape or design in the examples of the invention. When the same reference number is used and appears in one or more drawings, then that reference number is used consistently throughout in this specification and the drawings to refer to the same or similar parts.

The application illustrates examples of a tactical impact mitigation disposable over boot technology system that includes an over boot system with four impact engaging member portions and contains a honeycomb cell system with each honeycomb enclosed and sealed cell that holds non-Newtonian fluid independently, all distributed uniformly and throughout the entirety of the impact engaging four member system of the over boot system starting at the sole of the over boot to the toe of the over boot system, to the heel of the over boot system, and the two sides of the over boot system. Preferably, the depth of the honey comb is be greater/thicker at the base or sole of the impact engaging member of the over boot system. The ground contact base portion of the over boot system are formed to have a design to grip the ground. The toe and heel portions of the impact engaging member of the over boot system, which are continuous from the sole portion of the over boot system may not need to be as great/thick as the base or sole, and the two sides of the over boot system, also continuous from the sole portion of the over boot system may be as great/thick as the sole member to address hyper-extension/hyper-flexion of the wearers ankle. The crown or arch portion of the over boot system is stitched, glued, or some form of contact to maintain positioning in to the four impact engaging members of materials of the over boot. The Velcro straps secure the over boot to the wearers foot may be located at three locations starting at the toe area crossing over the arch to secure in front of the wearers ankle, the middle strap starts at the mid-arch crossing over to secure just under the wearer ankle, and the top strap starts at the base of the tibia/fibula crossing over to secure above the wearers ankle. The cowl neck of the opening of the upper or crown portion is designed to easily receive the wearers' boots or footwear.

The protective over boot is preferably comprised of four impact engaging members, an outer layer, an inner layer, a honeycomb layer containing non-Newtonian fluid, an upper layer secured to the wearer with three Velcro straps. The four impact engaging members having a sole member, a toe member, a heel member, and two side members. The four impact engaging members having an outer layer fabricated principally out of some form of plastic, rubber, or some similar material used in the prior art, with the sole member also containing a honeycomb sole containing non-Newtonian fluid, with the toe member also containing a honeycomb sole containing non-Newtonian fluid, with the heel member also containing a honeycomb sole containing non-Newtonian fluid, and with the two side members also containing a honeycomb sole of the cross-referenced patents. The four impact engaging members are all connected via stitching, adhesive, or some combination therein, or fabricated as one compete unit as seen in the prior art. The upper layer is a textile from the prior art, and is stitched and/or glued together via an adhesive. The over boot is secured using three Velcro straps with the cowl neck of the opening of the upper or crown portion is designed to easily receive the wearers' boots or footwear.

Referring now to the drawings, wherein the showings are for purposes of illustrating the present invention and not for purposes of limiting the same, FIGS. 1-6 show embodiments of an over boot, article of footwear or footwear cover that include a non-Newtonian fluid therein in accordance with preferred embodiments of the present invention.

Figure 2:
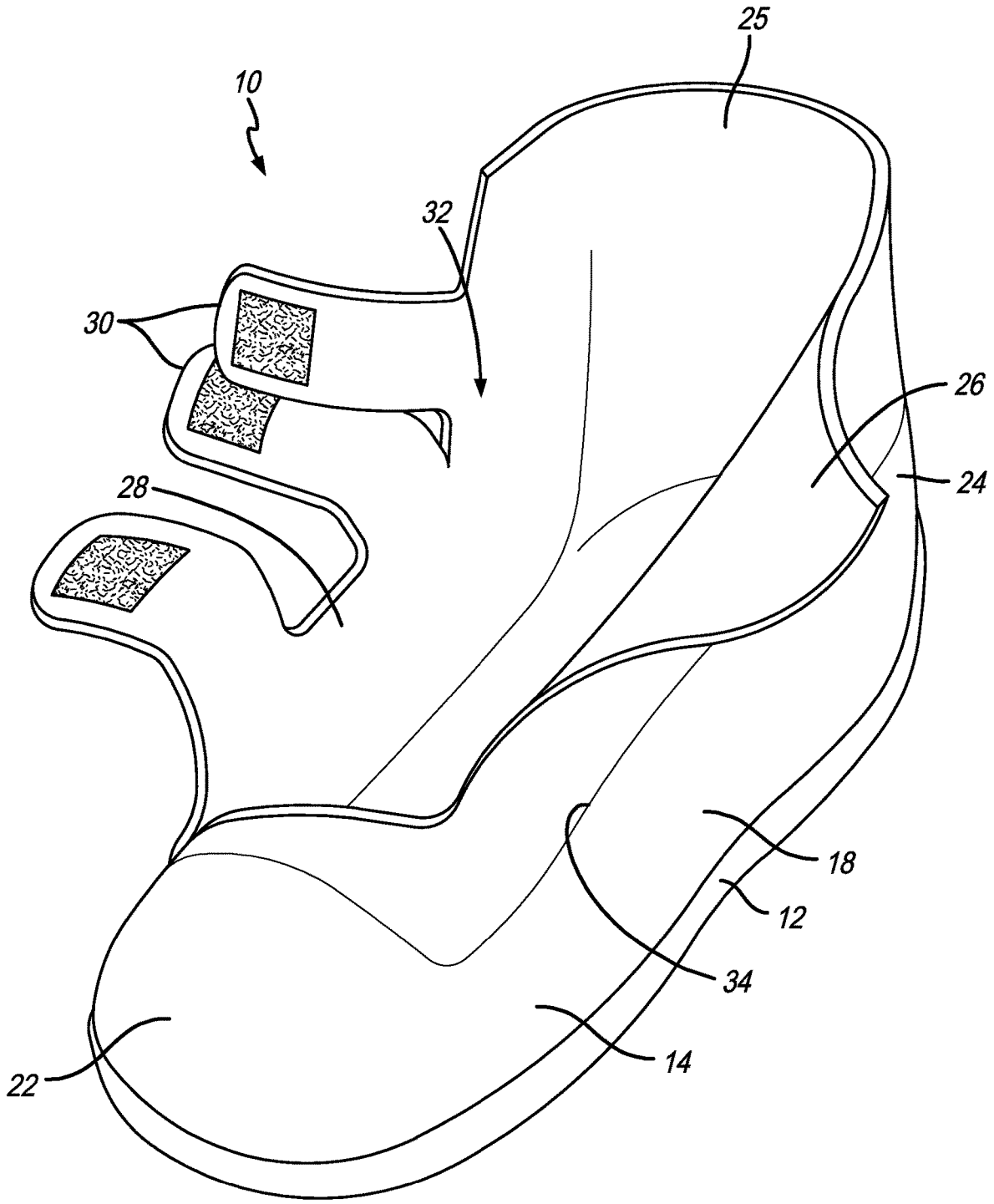
FIG. 2 is a perspective view of the article of footwear of FIG. 1 in the open position.
Figure 3:
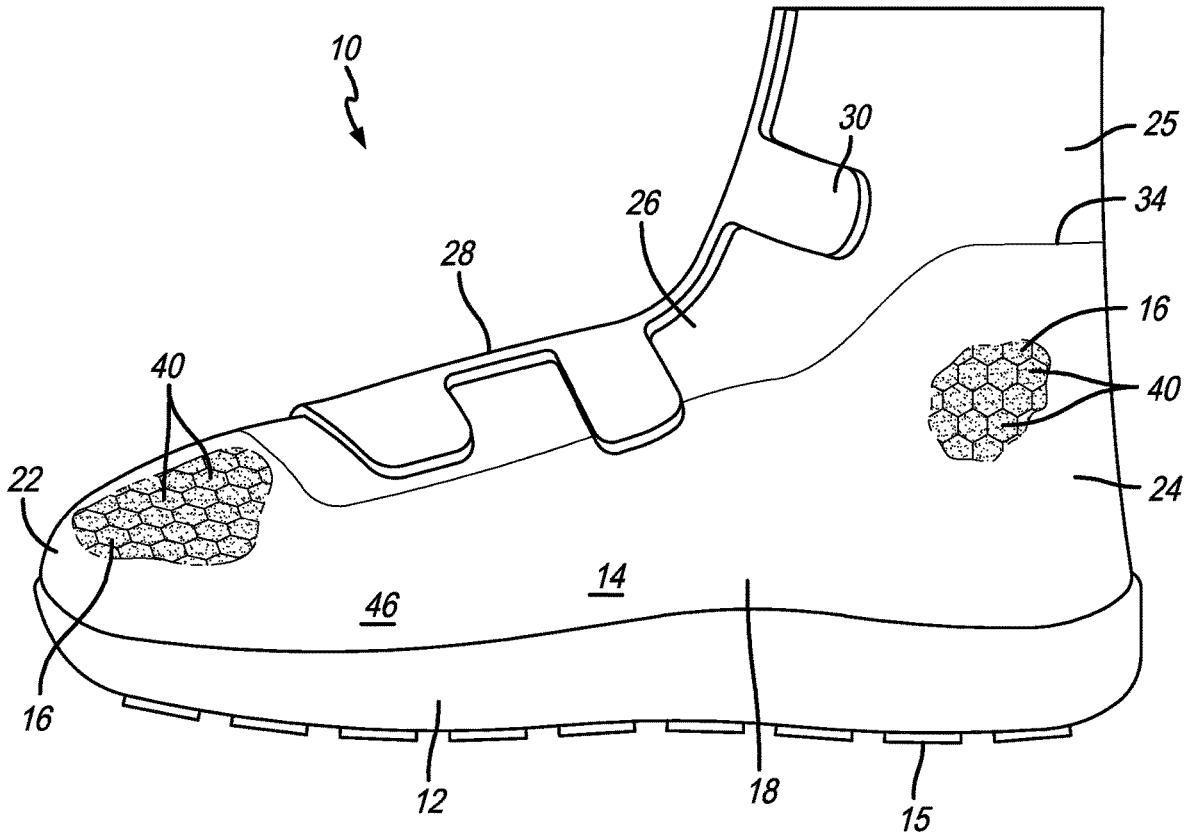
FIG. 3 is a medial side elevational view of the article of footwear of FIG. 1.

As shown in FIGS. 1-3, in a preferred embodiment, the footwear cover 10 generally includes a sole portion 12, an upper 14 and treads 15. In a preferred embodiment, the upper 14 includes an inside or medial portion 18, an outside or lateral portion 20, a toe portion 22, a heel portion 24, and a top portion 25 that includes a medial closure portion 26, a lateral closure portion 28 and a plurality of securing straps 30.

As shown in FIGS. 1 and 2 show the footwear cover 10 in the closed (FIG. 1) and open (FIG. 2) positions. In a preferred embodiment, the opening 32 defined when the footwear cover 10 is in the open position (when the medial closure portion 26, a lateral closure portion 28 are separated from one another) is large enough for a user to slip their foot and footwear (e.g., boot) into the boot receiving space 14 with little effort. In a preferred embodiment, the securing straps 30 include Velcro (hook and loop fastener) thereon, which connect to the top portion 25 to secure the footwear cover in the closed position. The securing straps 30 can extend from either the medial closure portion 26 or the lateral closure portion 28 and are connected to the other of the medial closure portion 26 and the lateral closure portion 28.

In a preferred embodiment, the footwear cover 10 includes a non-Newtonian disposed in the sole portion 12 and one or more of the medial portion 18, lateral portion 20, toe portion 22 and/or heel portion 24. In FIGS. 1-4, line 34 represents the separation between the top portion 25 (which preferably does not include non-Newtonian fluid therein and the medial portion 18, lateral portion 20, toe portion 22 and heel portion 24, which (one or more of) preferably do include non-Newtonian fluid therein. Line 34 may be where the top portion 25 is stiched, adhered or otherwise attached to the lower portions of the upper. However, in another embodiment, the entire upper 14 (top portion 25 and the medial portion 18, lateral portion 20, toe portion 22 and heel portion 24 may comprise the same piece of material). In a preferred embodiment, the top portion does not include an interior space nor a bladder member therein.

Figure 6:
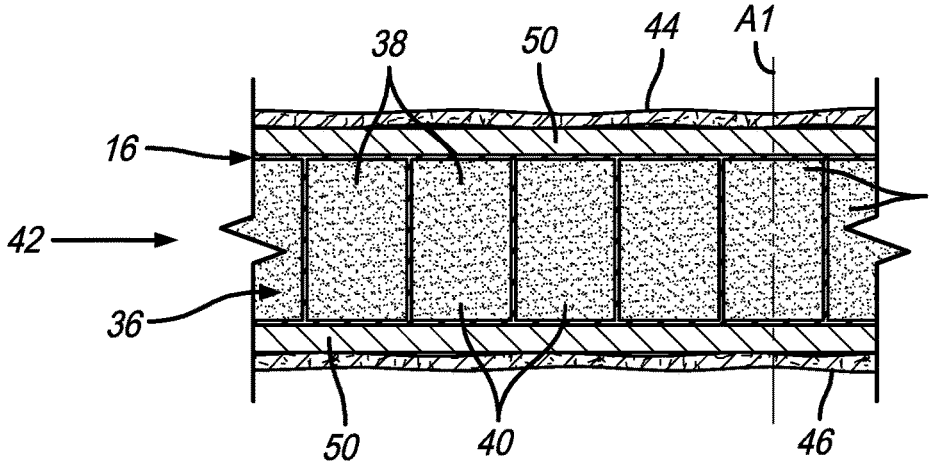
FIG. 6 is a cross-section of the article of footwear taken along line 6-6 in FIG. 5.

FIG. 6 shows a cross-section of the portions of the footwear cover 10 that include non-Newtonian fluid therein. In a preferred embodiment, the non-Newtonian fluid is encased in one or more bladder members 16. Preferably, the bladder member 16 defines a bladder interior 36 and the non-Newtonian fluid 38 is disposed in the bladder interior 36. In a preferred embodiment, the non-Newtonian fluid comprises corn starch and non-toxic antifreeze. However, any non-Newtonian fluid is within the scope of the present invention.

Figure 4:
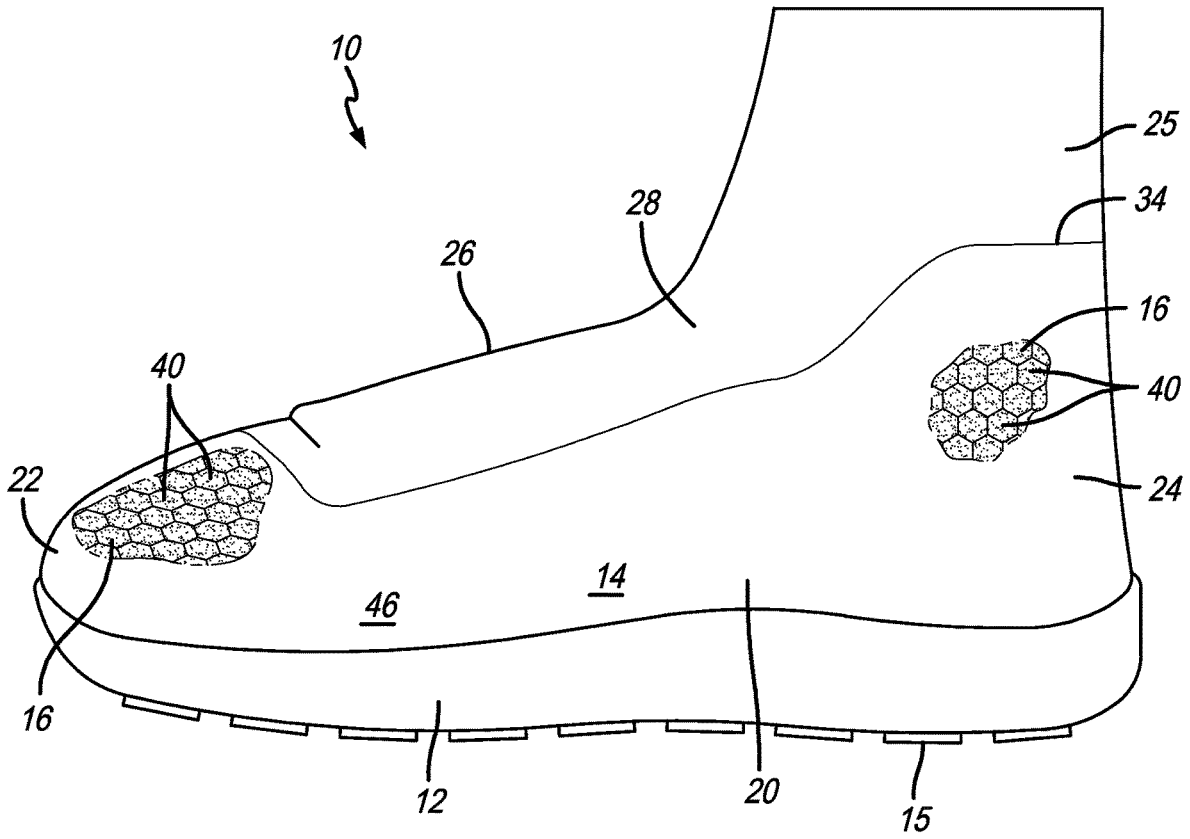
FIG. 4 is a lateral side elevational view of the article of footwear of FIG. 1.
Figure 5:
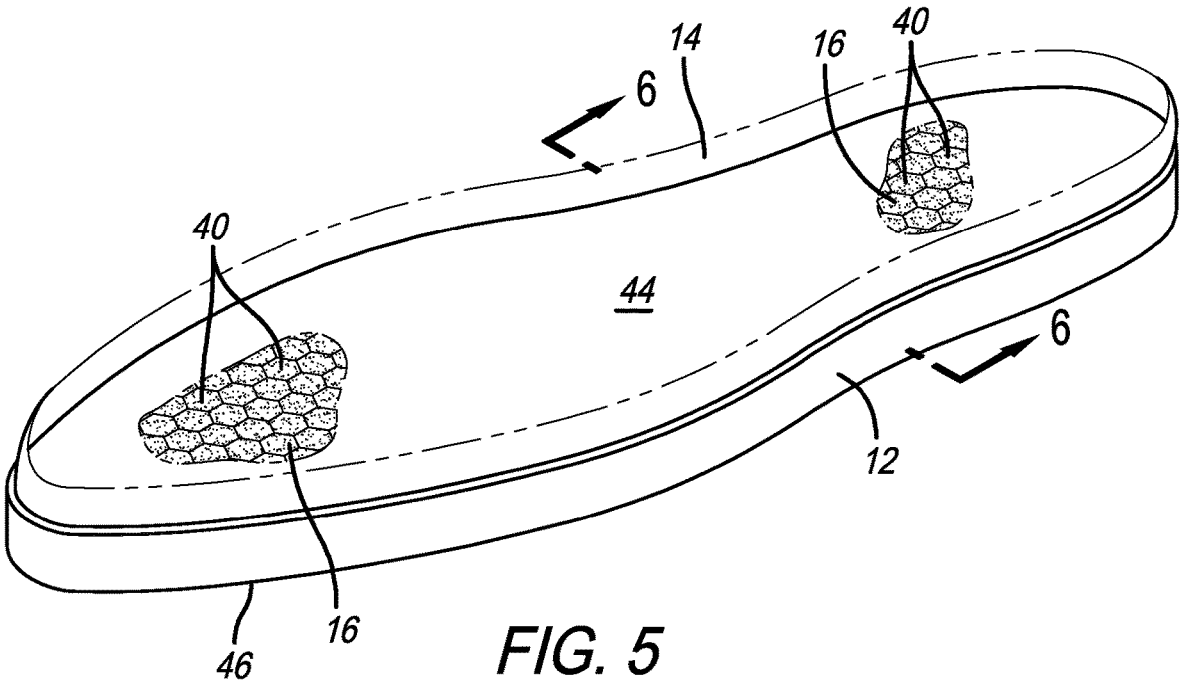
FIG. 5 is a perspective view of the sole portion of the article of footwear of FIG. 1.

The bladder member 16 is preferably made of a polymer so that it is malleable and durable. The bladder member 16 can be completely open on the inside thereof (i.e., a single cavity) and have the non-Newtonian fluid 38 distributed throughout. In another embodiment, the bladder member 16 can include a plurality of cells therein. As shown in FIGS. 3-5, in a preferred embodiment, the bladder member 16 includes a plurality of honeycomb cells 40 and each cell includes the non-Newtonian fluid 38 disposed therein.

The bladder member 16 or members are disposed in the sole portion 12 and the upper 14 within pockets or an interior space 42 defined between inner and outer layers 44 and 46. A single bladder member may extend from the sole portion 12 and up and into the medial portion 18, lateral portion 20, toe portion 22 and heel portion 24. Or, a separate bladder member can be used in each of the sole portion 12, medial portion 18, lateral portion 20, toe portion 22 and heel portion 24. In another embodiment, a first bladder portion 16 can be included in the sole portion 12 and a second bladder portion 16 can be used in the desired portions of the upper 14. Different embodiments can have bladder members in different locations, as desired and any combination is within the scope of the present invention.

It will be appreciated that the interior space 42 defined by the inner and outer layers 44 and 46 can be continuous or may include dividers therein that define separate various portions of the interior space into separate pockets for the inclusion of bladder members therein. In a preferred embodiment, soft layers or foam layers 50 can be included between the inner and outer layers 44 and 46 and the bladder member 16. The foam layers 50 surround the bladder member 16 and provide cushioning and comfort. The foam member can be omitted if desired or it can be made of other soft materials that are not foam.

As shown in FIG. 5, in a preferred embodiment, each cell 40 defines a cell axis A1 that extends generally perpendicular to the outer surface of the wearer's skin. In other words, the cell axes are oriented generally perpendicular to the surfaces of the inner and outer layers 44 and 46. In another embodiment, the cells can be oriented so that the cell axes are not perpendicular to the wearer's skin. In another embodiment, there can be multiple layers of cells.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art may recognize. Further, any specific numbers noted herein are only examples: alternative implementations may employ differing values, measurements or ranges.

The teachings of the disclosure provided herein can be applied to other systems, not necessarily the system described above. The elements and acts of the various embodiments described above can be combined to provide further embodiments. Any measurements described or used herein are merely exemplary and not a limitation on the present invention. Other measurements can be used. Further, any specific materials noted herein are only examples: alternative implementations may employ differing materials.

Any patents and/or patent applications and other references are articles noted above or herein, including any that may be listed in accompanying filing papers, charts or figures are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. An over boot system configured to receive an article of footwear therein, the over boot system comprising:

a sole portion that includes an inner layer and an outer layer that cooperate to define at least a first interior space therebetween, at least a first bladder member disposed in the first interior space, wherein the first bladder member includes inner and outer walls that define a bladder interior therebetween, wherein a non-Newtonian fluid is disposed in the bladder interior, and an upper connected to the sole portion, wherein the upper includes at least a first securement strap for securing the footwear cover in a closed position.

2. The over boot system of claim 1 wherein the first bladder member includes a plurality of cells defined therein extending between the inner and outer walls, wherein each cell includes the non-Newtonian fluid disposed therein.

3. The over boot system of claim 2 wherein each cell has a honeycomb shape.

4. The over boot system of claim 3 wherein each cell defines a cell axis, wherein the outer layer of the sole portion defines an outer surface, and wherein the cell axes are oriented generally perpendicular to the outer surface.

5. The over boot system of claim 1 wherein the first bladder member is made of a polymer.

6. The over boot system of claim 1 further comprising a plurality of bladder members that are enclosed in a plurality of pockets defined between the inner and outer layers of the sole portion.

7. The over boot system of claim 1 wherein the upper includes a medial portion, a lateral portion, a toe portion, a heel portion and a top portion, wherein the top portion includes a medial closure portion and a lateral closure portion, and wherein the first securement strap is connected to one of the medial closure portion or lateral closure portion.

8. The over boot system of claim 7 wherein the upper includes an inner layer and an outer layer that cooperate to define a second interior space therebetween, wherein at least a second bladder member is disposed in the second interior space, wherein the second bladder member includes inner and outer walls that define a bladder interior, wherein a non-Newtonian fluid is disposed in the bladder interior.

9. The over boot system of claim 8, wherein the second interior space is defined at least partially in the toe portion, the heel portion, the medial portion and the lateral portion, and wherein the second bladder member is positioned in one or more of the toe portion, the heel portion, the medial portion and the lateral portion.

10. An over boot system configured to receive an article of footwear therein, the over boot system comprising:

a sole portion that includes an inner layer and an outer layer that cooperate to define at least a first interior space therebetween, at least a first sole bladder member disposed in the first interior space, wherein the first sole bladder member includes inner and outer walls that define a bladder interior, wherein the first sole bladder member includes a plurality of cells defined therein, wherein each cell includes the non-Newtonian fluid disposed therein, wherein each cell has a honeycomb shape, and an upper connected to the sole portion, wherein the upper includes a medial portion, a lateral portion, a toe portion, a heel portion and a top portion, wherein the upper includes an inner layer and an outer layer that cooperate to define a second interior space therebetween, wherein the second interior space is defined in the toe portion, the heel portion, the medial portion and the lateral portion, wherein one or more upper bladder members are positioned in the second interior space and in the toe portion, the heel portion, the medial portion and the lateral portion, wherein each of the upper bladder members include inner and outer walls that define a bladder interior, and wherein a non-Newtonian fluid is disposed in each bladder interior, wherein the top portion includes a medial closure portion, a lateral closure portion and at least a first securement strap for securing the footwear cover in a closed position, wherein the first securement strap is connected to one of the medial closure portion or lateral closure portion.

11. The over boot system of claim 10 wherein the top portion does not include a bladder member therein.

12. The over boot system of claim 1 further comprising a first foam layer between the outer layer of the bladder member and the outer layer of the sole portion and a second foam layer between the inner layer of the bladder member and the inner layer of the sole portion.

13. The over boot system of claim 1 wherein the sole portion and the upper together define a footwear interior, wherein the over boot system further comprises an article of footwear positioned in the footwear interior.

* * * * *